US005852849A

United States Patent [19]

Lansing et al.

[11] Patent Number: 5,852,849

[45] Date of Patent: Dec. 29, 1998

[54] BIB HOLDER FOR HOLDING DENTAL BIBS

[75] Inventors: Thomas A. Lansing, Pine Springs, Minn.; Phillip E. Mark, Orlando, Fla.

[73] Assignee: Pinnacle Products of Wisconsin, Inc., Lakeville, Minn.

[21] Appl. No.: 881,654

[22] Filed: Jun. 24, 1997

[51] Int. Cl.[6] ..... A45F 5/04

[52] U.S. Cl. ..... 24/3.4; 24/7; 24/298

[58] Field of Search ..... 2/246, 244, 310, 2/240, 300, 52; 224/257, 258; 24/7–9, 300, 298, 301, 302, 3–13, 3.4

[56] References Cited

U.S. PATENT DOCUMENTS

| | | | |
|---|---|---|---|
| 211,479 | 1/1879 | Shelby | 24/9 X |
| 2,820,269 | 1/1958 | Wolff | 24/300 X |
| 2,865,069 | 12/1958 | Gamble | 24/9 |
| 3,126,600 | 3/1964 | De Marre | 24/301 |
| 4,986,500 | 1/1991 | Campbell | 24/301 X |
| 5,377,391 | 1/1995 | Foster | 24/301 X |
| 5,414,903 | 5/1995 | Porteous . | |
| 5,419,475 | 5/1995 | Naritomi | 224/257 |
| 5,655,270 | 8/1997 | Boisvert | 24/301 X |
| 5,673,464 | 10/1997 | Whittaker | 24/301 |
| 5,676,178 | 10/1997 | Ehnimb | 24/302 X |

FOREIGN PATENT DOCUMENTS

| | | | |
|---|---|---|---|
| 28295 | 11/1910 | United Kingdom | 24/9 |
| 818555 | 8/1959 | United Kingdom | 24/300 |

*Primary Examiner*—James R. Brittain
*Attorney, Agent, or Firm*—Foley & Lardner

[57] ABSTRACT

A bib holder particularly suited for holding dental bibs, includes fasteners and a strap between them wherein the strap is made of a flexible material with a central expanded band portion with two flat sides and elongated rod portions extending from the band portion. Bib fasteners are attached to the end terminals of the rod portions. This strap is comfortable when placed on the patient, is easily stored, may be made in bright colors and designer designs, and further may contain words or other designs on the flat sides of the band portion.

10 Claims, 2 Drawing Sheets

FIG. 1
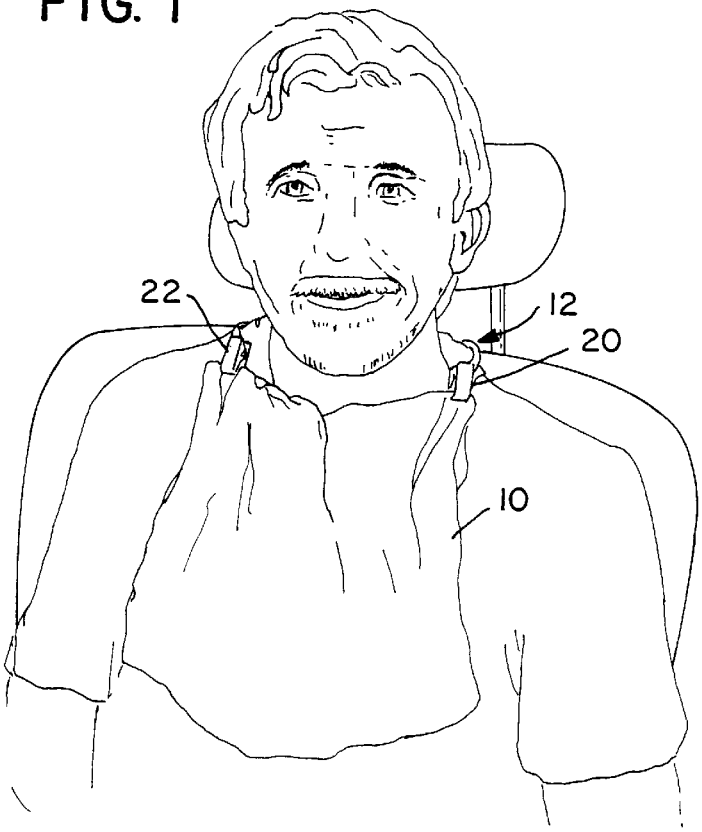
FIG. 4
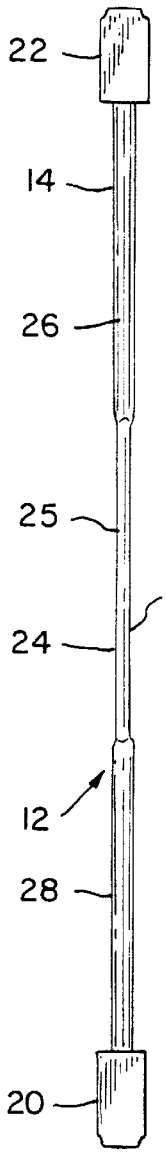
FIG. 3
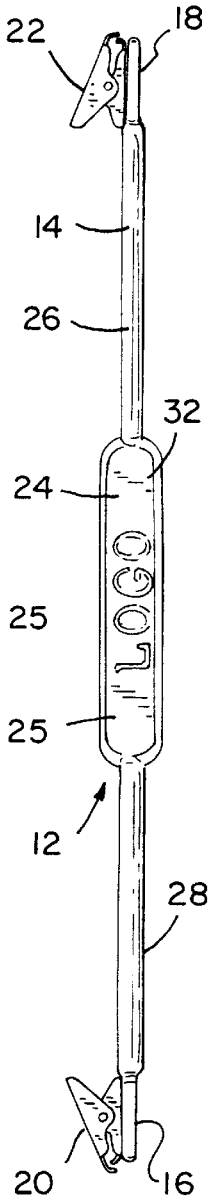
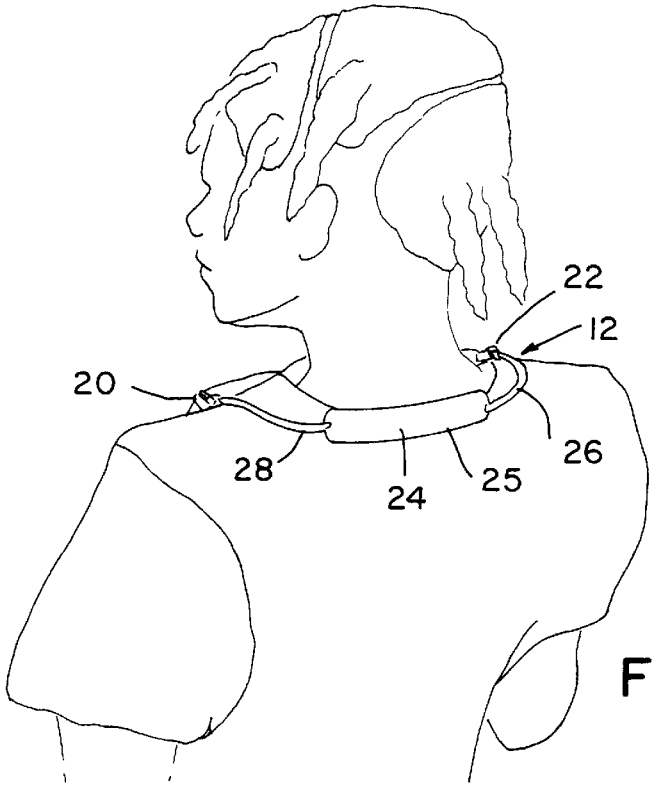
FIG. 2

BIB HOLDER FOR HOLDING DENTAL BIBS

FIELD OF THE INVENTION

This invention pertains generally to the fields of dentistry and implements therefore, and to holders for bibs of various types, and particularly to systems for holding dental bibs on patients.

BACKGROUND OF THE INVENTION

During dental procedures at the dentist's office, a patient's clothing is protected by a bib, which is placed across the chest of the patient. Previously, this bib has been held in place by straps, which encircled the nape of the patient's neck. At either end of the strap are clips which fasten to the bib and secure it in place. These straps have been made of various materials. Such materials include a metal ball and link chain, expandable covered wire, and various types of plastic tubing of differing degrees of thickness and flexibility. Disposable plastic straps which can be torn apart in the middle are shown in U.S. Pat. No. 5,414,903.

While these bib-holding straps are functional, they suffer from certain disadvantages. Specifically, they tangle easily in storage, and may also entangle the patient's clothing, hair or jewelry while in use. They may be uncomfortable during use and allow the bib to move during the dental procedures. Further, such straps cannot be used conveniently to carry logos, trade names, slogans, or other designs, for informational, advertising or other purposes.

SUMMARY OF THE INVENTION

A bib holder in accordance with the present invention is comfortable when worn by the dental patient, is easily stored, may be made in bright colors and designer designs, and may carry words or other designs for information or advertising purposes. The dental bib holder includes a flexible strap of a length sized to go at least partially around the neck of a patient, left and right terminals at the ends of the straps, and left and right fasteners secured to the strap at its terminals for fastening a dental bib in use position. The strap also has a integral central band formed as a wide expanded portion with two flat sides, which fits comfortably on the back of the patient's neck. Flexible, elongated rod portions extend from the central band to the terminals of the strap.

The strap is preferably lightweight, relatively soft and flexible, and is preferably formed of a rubber material or a synthetic organic plastic. The material of the strap may be single-colored or multi-colored. The central band may contain words or other designs on the flat surface of one or both sides. Such material or designs may be imprinted or otherwise affixed to the strap, or they may be an integral part of the strap such as by being molded into the strap. Preferably, such material is visible when the strap is in use. The strap may be formed by injection molding.

The fasteners may comprise spring loaded jaw-type clips secured to the terminals of the strap in a fixed position in alignment with the length of the strap. The plane of the jaws of jaw-type clips are preferably aligned to be approximately at a right angle to the plane of the flat surface of the central expanded portion. Preferably, the clips are oriented such that, when the holder is in use, the fixed portion of the clip, which is attached to the strap, lies against the patient's chest, while any decorative material present on a flat surface of the central expanded portion lies facing away from the patient's neck so that it is visible to an observer.

Because the bib holder is formed of a flexible rubber or rubber-like plastic material, it readily and comfortably conforms to the shape of the neck and has a soft feel against the skin of the patient. Further, the rubber-like material of the bib holder is a good heat insulator and is readily warmed when in contact with the neck of the patient, and is thus more comfortable than a metal chain which often feels cold when placed against the skin of the neck.

The dental bib holder of the invention is formed of materials that may be readily cleaned and sterilized, or the bib holder can be disposed of after use if desired.

The present invention thus provides a new bib holder for securing dental bibs on patients which is easily fastened to the bib, readily introduced around the neck of the patient, more comfortable during wear, and less likely to tangle with patient's clothing, hair or jewelry. The bib holder also stores more easily with less tangling in a storage bin. The strap of the bib holder may be made in bright colors and designs, and may carry a trade name, logo, slogan, or other design on the strap.

Further objects, features, and advantages of the present invention will be apparent from the following detailed description when taken in conjunction with the accompanying drawings.

BRIEF DESCRIPTION OF THE DRAWINGS

In the drawings:

FIG. 1 is an illustrative view of a dental bib holder in accordance with the present invention in use position on a patient as viewed from the front of the patient.

FIG. 2 is a pictorial view of the bib holder of the invention in use position on a patient from the back of the patient.

FIG. 3 is a top view of the bib holder.

FIG. 4 is a side view of the bib holder.

DETAILED DESCRIPTION OF THE INVENTION

Figure 5:
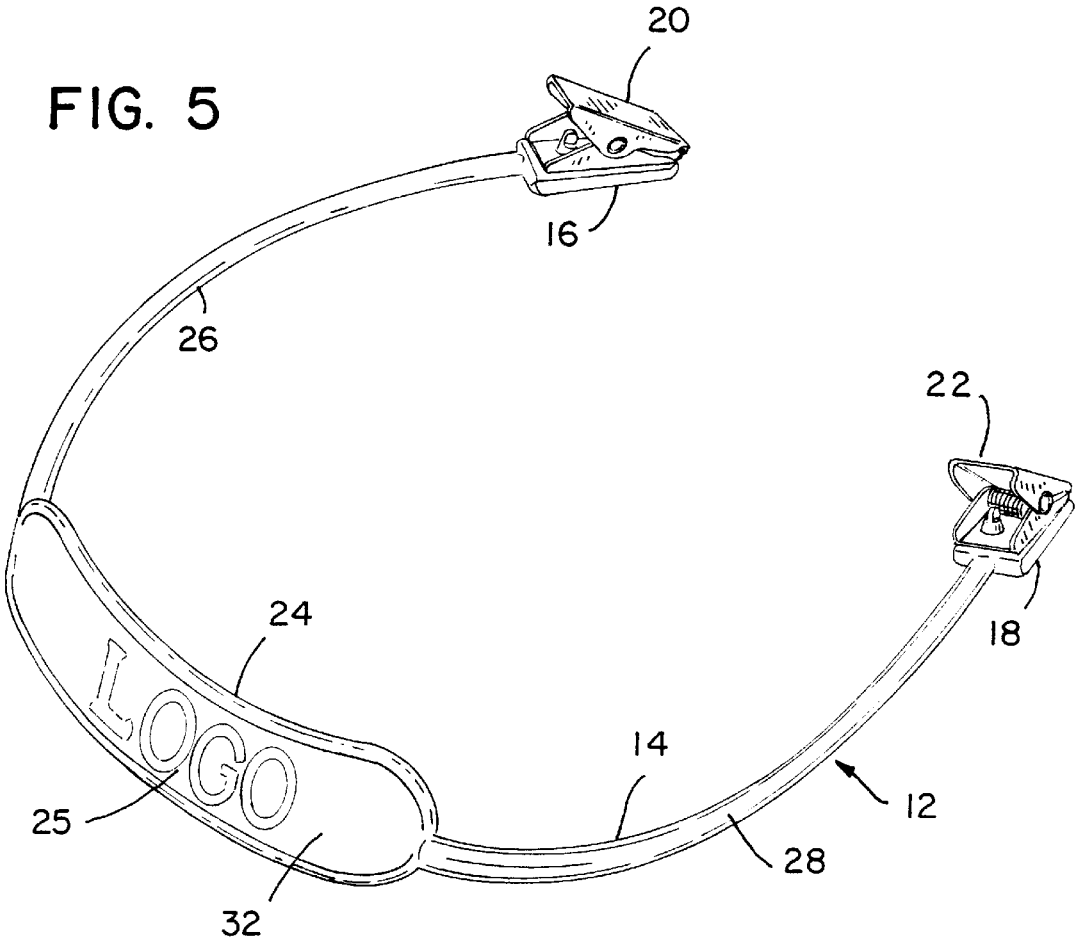
FIG. 5 is a perspective view of the bib holder in the position in which it is worn during use.

With reference to the drawings, in FIGS. 1 and 2 a dental patient is shown wearing a dental bib 10 across the chest, secured in place by a bib holder 12 in accordance with the invention. The bib holder 12 has a flexible strap 14 having a central expanded band portion 24 with two flat sides and two ends, flexible, elongated rod-like portions 26 and 28 attached to each end of the central band portion, and terminals 16 and 18 at the ends of the rod portions 26 and 28. The central band portion 24 has a width significantly greater than its thickness, and much greater than the diameter of the rod portions. The total length of the flexible strap 14 is selected to be sufficient at least to go around the nape and preferably all the way around the neck of a patient. Bib fasteners 20 and 22 are secured to each terminal end 16 and 18. The fasteners 20 and 22 may be attached to the rod portions at the terminals 16 and 18 in a fixed position as described further below, or, if desired, they may be rotatably secured to the rod portions at the terminals 16 and 18 for increased flexibility and comfort during use.

As best shown in FIGS. 3 and 4, the central expanded band portion 24 has two flat sides 25, which will typically be located at the nape of the patient's neck for increased comfort during use (see FIG. 2). The band portion 24 is relatively thin, (it may even be thinner than the diameter of the rod portions 26 and 28), to increase the ability of the band 24 to bend around the neck of the patient, and thus increasing patient comfort during use. The shape and design of the strap 14, and especially the presence of the expanded flat band portion 24, results in less tangling during storage, and decreased likelihood of the strap entangling the patient's clothing, hair, or jewelry while in use. It also serves to keep the bib to which it is attached more firmly in proper position during use.

Additionally, as shown in FIG. 3, the surface of one or both sides 25 of the central expanded band portion 24 may contain printed material or other images or designs 32 imprinted or otherwise affixed to the surface, or molded as an integral part of the surface, all referred to generally herein as decorative material. Preferably, the decorative material is visible when the strap is in use. Such decorative material may comprise, for example, logos, trademarks, trade names, or advertising slogans. Alternatively, such decorative material may comprise humorous or comforting designs, such as inspirational quotations or cartoon characters or soothing scenes. Such decorative material may further or in addition comprise bold or bright or "designer" colors, or other material which attracts or is designed to attract the attention of either the wearer or the user or both. Such decorative material may comprise sparkling or glittering substances, or fluorescent material. The strap itself may comprise single-colored or multi-colored material, and may in addition comprise attention-attracting material such as sparkling or glittering substances, or fluorescent material.

The strap 14 is preferably integrally formed of a material that is flexible, soft, resilient and lightweight, and may comprise a rubber material or a synthetic organic plastic. Preferably, such material can be sterilized. A preferred material is a colorable thermoplastic elastomer with good fluid resistance which may be autoclaved, such as SANTOPRENE® thermoplastic rubber available from Advanced Elastomer Systems, L.P. Other flexible elastomeric materials may be used as desired. The strap 14 may be formed by injection molding, extrusion and flattening, blow molding or other melt processing techniques. Preferably, the strap 14 is formed by injection molding.

The terminals 16 and 18 may be flattened as illustrated in FIGS. 3 and 4, and integrally formed with the rest of the elongated rods 26, or they may be any shape necessary to accommodate the fasteners 20 and 22. Preferably, the plane of the terminals 16 and 18 is at a right angle to the plane of the flat sides 25 the central band portion 24, so that the line of intersection of the jaws of the fasteners 20 and 22 are also at a right angle to the flat sides of the central band 24, as discussed further below.

Figure 6:
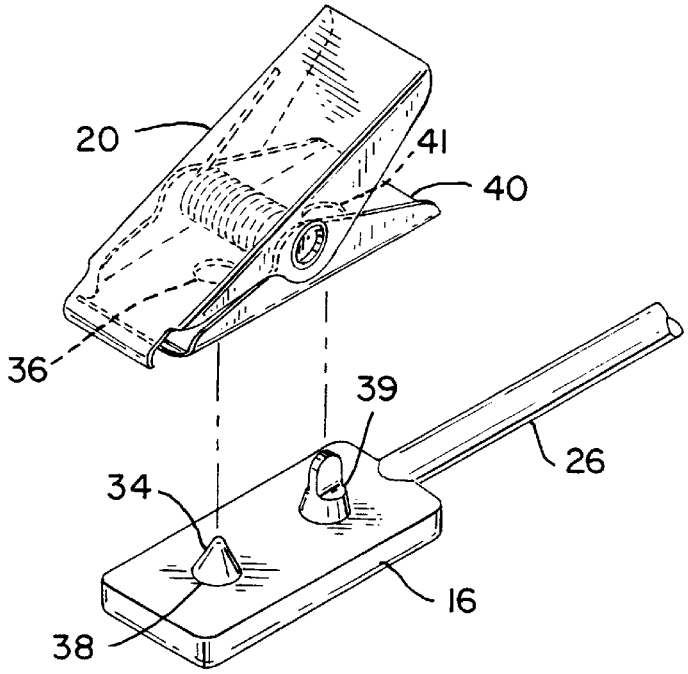
FIG. 6 is a perspective view illustrating a preferred structure by which a fastener may be attached to the strap.

The fasteners 20 and 22 may be any desired fastening means for bibs, including but not limited to alligator clips, spring clips, clamps, or any other fastening means that will allow a bib to be releasably attached to the bib holder. Preferably, such fasteners are clips having spring loaded jaws as best illustrated in FIGS. 3, 4, and 6.

The fasteners 20 and 22 may be affixed to the strap terminals 16 and 18 by any means, including rivets, pins, and adhesives, or they may be integrally formed during the molding process. Such attachment means may be fixed or rotatable. Preferably, the fasteners 20 and 22 are attached to the strap by structures which are an integral part of the strap terminals 16 and 18, as best illustrated in FIG. 6. In one embodiment, such means may be a peg 34 which fits into an opening 36 in the fastener 20. The shape of the peg 34 forms a locking means which keeps the fastener 20 firmly attached to the strap terminal 16. The diameter of the peg 34 is increased in a downward direction, ending in a flared lower edge 38, immediately below which the diameter of the peg 34 is less than that of the flared lower edge 38. The diameter of the opening 36 in the fastener 20 is also less than that of the flared lower edge 38, but slightly greater than that of the end of the peg 34 below the flared edge 38. One example of this peg shape consists of a lower cylinder of very short length topped by an inverted cone; the peg joins the terminal by the lower cylinder. This type of attachment resembles a much simplified Christmas tree. Such an attachment may also be supplied to the strap terminal 16 after the strap 14 has been formed.

When the opening 36 of the fastener 20 is pushed onto the peg 34, the sides of the peg 34 are compressed until the fastener opening 36 pops over the flared lower edge 38, which then expands over the fastener opening 36 and keeps the fastener 20 firmly attached to the strap terminal 16. Preferably, the fastener 20 is also attached to the strap terminal 16 by a second peg 39 as shown in FIG. 6, with the peg 39 being formed similarly to the peg 34 and fitting into a second opening 41 in the fasteners.

The mating edges of the jaws of the clip fasteners 20 and 22 may be parallel to or perpendicular to or at any angle between parallel and perpendicular to the flat sides 25 of the strap 14. When affixed perpendicularly to the flat sides 25 of the central band portion 24, the mating jaws of the clips tend naturally to be parallel to the chest of the patient and to the material of the bib when in place on the patient, as shown in FIGS. 1 and 2. Preferably, the fasteners 20 and 22 are fixedly attached to the strap terminals 16 and 18, and the planes of the strap terminals 16 and 18 are molded to be at a right angle relative to the plane of the sides 25 of the central band portion 24.

The entire bib holder 12 may be cleaned and sterilized for sanitary reuse. Such sterilization methods include applying high temperature and pressure steam (such as in autoclaving) or the use of chemicals. Preferably, the dental bib holder 12 is autoclavable. Alternatively, the bib holder 12 may economically be disposed of after use.

In the use of the dental bib holder of the invention, the elongated rod portions 26 and 28 of the bib holder, with the end terminals 16 and 18 and fasteners 20 and 22 attached thereto, are draped over the patient's shoulders such that the fasteners 20 and 22 are located in front of the patient, and a dental bib is releasably attached to the fasteners 20 and 22 by squeezing the spring loaded fasteners to open the jaws to clip onto the bib.

Though described in detail herein with respect to a dental bib, it should be noted that the present invention is not limited in application to dental bibs only. The bib holder may be used with other types of bibs, including children's bibs, or dinner bibs, such as are used when eating lobster, or patient bibs, when feeding those unable to feed themselves or who need additional protection.

It is understood that this invention is not confined to the particular structures herein illustrated and described, but embraces such modified forms thereof as come within the scope of the following claims.

What is claimed is:

1. A bib holder suited for holding dental bibs comprising:

a flexible strap having a central expanded band portion with two flat sides and two opposite ends, and two elongated rod portions attached to the opposite ends of the central band portion, the rod portions each having a terminal at an end thereof opposite the central band portion, the central band portion having a width greater than the width of the rod portions, the length of the flexible strap being sufficient to go at least partially around a patient's neck, and a bib fastener secured to the terminal end of each rod portion.

2. The bib holder of claim 1 wherein the central band portion and the rod portions are integrally molded of a resilient rubber-like material.

3. The bib holder of claim 1 wherein at least one flat side of the central band portion contains decorative material thereon.

4. The bib holder of claim 1 wherein at least one flat side of the central band portion contains words integrally formed on the surface thereof.

5. The bib holder of claim 1 wherein the fasteners are clips having spring loaded jaws and the fasteners are secured to the strap terminals in a fixed position such that the plane of the jaws of the clips is at a right angle relative to the plane of the flat sides of the central band portion.

6. The bib holder of claim 1 wherein the central band portion and the rod portions are integrally molded of a thermoplastic elastomer.

7. The holder of claim 1 wherein the strap is made of a single-colored material.

8. The holder of claim 1 wherein the strap is made of a multi-colored material.

9. The bib holder of claim 1 wherein the bib holder is made of material that may be sterilized by a method selected from the group consisting of autoclaving and chemical sterilization.

10. A method for securing a dental bib to a patient comprising:

(a) providing a bib holder including a flexible strap having a central expanded band portion with two flat sides and two opposite ends, and two elongated rod portions attached to the opposite ends of the central band portion, the rod portions each having a terminal at an end thereof opposite the central band portion, the central band portion having a width greater than the width of the rod portions, the length of the flexible strap being sufficient to go at least partially around a patient's neck, and a bib fastener secured to the terminal of each rod portion;

(b) resting a flat side of the central band portion of the strap against the back of the patient's neck;

(c) draping the rod portions with the fasteners attached thereto over the patient's shoulders such that the fasteners are located in front of the patient; and (d) attaching a dental bib to the fasteners.

* * * * *